US006223854B1

(12) United States Patent
Nolz

(10) Patent No.: US 6,223,854 B1
(45) Date of Patent: May 1, 2001

(54) SAFETY AND SUPPORT GARMENT FOR USE IN TREE STAND

(76) Inventor: Jason Nolz, 935 E. Main St., Manchester, IA (US) 52057

( * ) Notice: Subject to any disclaimer, the term of this patent is extended or adjusted under 35 U.S.C. 154(b) by 0 days.

(21) Appl. No.: 09/328,251

(22) Filed: Jun. 8, 1999

(51) Int. Cl.[7] ..... A47L 3/04; A63B 27/00
(52) U.S. Cl. ..... 182/3; 182/7; 182/133
(58) Field of Search ..... 182/3, 6, 7, 9, 182/133

(56) References Cited

U.S. PATENT DOCUMENTS

| | | | | |
|---|---|---|---|---|
| 2,254,179 | | 8/1941 | Hoyt . | |
| 3,415,340 | * | 12/1968 | Kinkade | 182/7 |
| 3,869,021 | * | 3/1975 | Sutherland et al. | 182/3 |
| 4,103,758 | | 8/1978 | Himmelrich . | |
| 4,921,069 | | 5/1990 | Boyles . | |
| 4,928,789 | | 5/1990 | Claeys . | |
| 5,069,153 | * | 12/1991 | Pascher | 182/3 X |
| 5,180,030 | | 1/1993 | Smaby . | |
| 5,341,896 | | 8/1994 | Amacker . | |
| 5,531,292 | * | 7/1996 | Bell | 182/3 |

* cited by examiner

*Primary Examiner*—Daniel P. Stodola
*Assistant Examiner*—Hugh B. Thompson
(74) *Attorney, Agent, or Firm*—James C. Nemmers

(57) ABSTRACT

A safety and support garment that is worn by a user to assist the user in climbing a tree and then maintaining either a standing or sitting position in the tree. The garment includes a girdle with leg holes through which the user extends his or her legs and pulls the garment up around the waist. A rigid seat is secured to the girdle and is positioned around the user's lower back while the user is on the ground to provide lumbar support, and then is positioned to serve as a seat when the user is in a tree. In addition, ropes of adjustable lengths are attached to the girdle as support and safety ropes for encircling the tree while allowing the user to freely move completely around the tree. Suspenders or an additional harness may also be attached to the girdle for additional support and comfort.

13 Claims, 2 Drawing Sheets

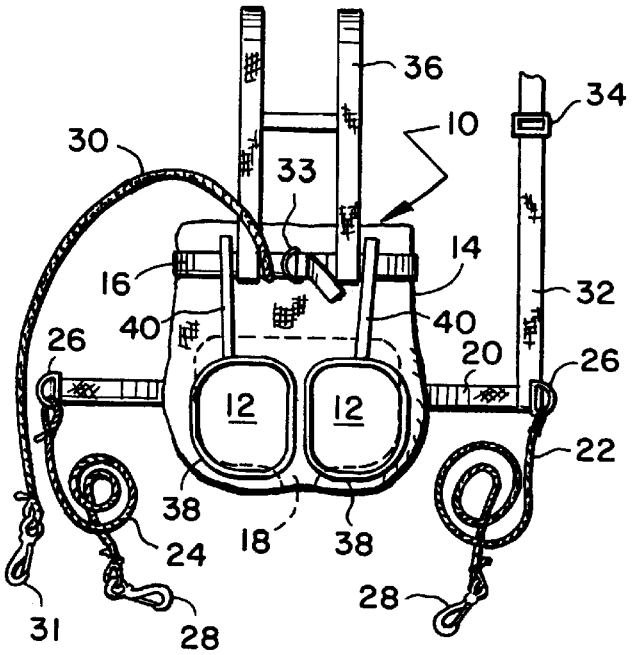
FIG. 1
FIG. 2
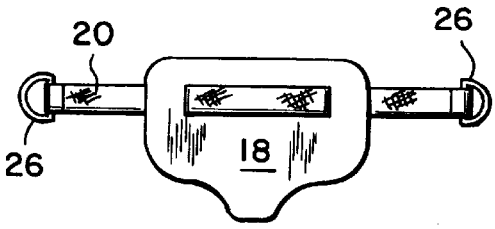
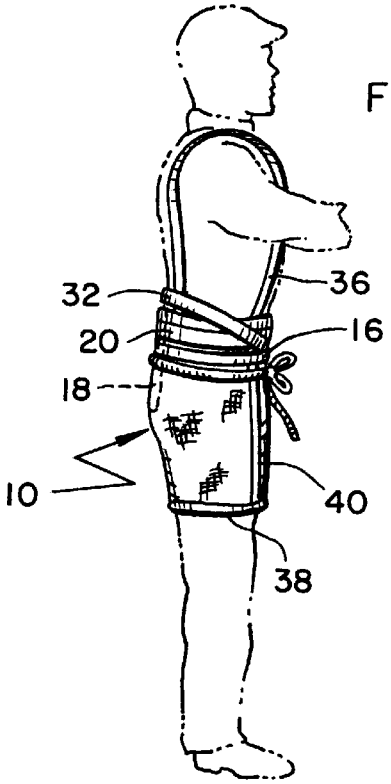
FIG. 3
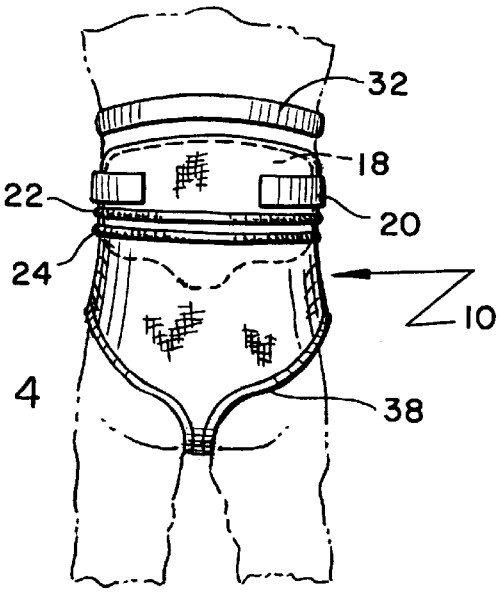
FIG. 4

SAFETY AND SUPPORT GARMENT FOR USE IN TREE STAND

BACKGROUND OF THE INVENTION

The invention relates generally to situations where a user wishes to position himself or herself safely for an extended period of time in a tree or on another vertical support for a better view of the surrounding area. More particularly, the invention relates to a safety and support garment which allows the user to comfortably be positioned in a vertical position either in a sitting or standing position with the ability to easily move completely around the tree.

Hunters and photographers frequently want to be positioned above the ground so as to obtain a better view of the surrounding territory while being out of the view of wildlife that is being hunted or photographed. Climbing or platform tree stands are well known for assisting a person in maintaining a position in a tree above the ground with the hands free to operate a camera, use a bow and arrow, rifle, shotgun, etc. Although most of the known tree stands provide some support for the user, they do not provide any security from falling and they restrict the mobility of the user while in the tree. Moreover, they are bulky to carry and difficult to install. Also, climbing tree stands that are commercially available can only be used with branch-less, straight trees that are of a specific diameter. Known platform stands require the user to carry the stand up the tree and secure it to the tree in a selected spot. Both types of stands demand that the user have considerable strength and agility, and neither stand secures the user to the tree, the user is placed in a vulnerable and unsafe position. Moreover, being of metal, these known stands are noisy to carry and install making them not well suited for hunting because they will frighten the game being hunted. Whether hunting or photographing, it is necessary to have both hands free, and it also highly desirable to be able to move completely around the tree quickly, easily and safely. Moreover, hunters and photographers often wait extended periods of time for the wildlife to appear in the area. Comfort and fatigue therefore become a factor. In addition, any garment or device designed to assist the hunter or photographer preferably should be easy to use, quiet and not bulky, and be easily carried or worn while on the ground without restricting the mobility of the user who must sometimes walk long distances to get to the desired secluded area.

It is therefore an object of the invention to provide a garment that will provide support and safety while assisting the user in climbing a tree and maintaining a position in the tree over an extended period of time.

It is the further object of the invention to provide a safety and support garment that provides comfort and safety by securing the user to the tree while providing versatility so that the user can position himself or herself anywhere around the tree and move from one position to another quickly and easily.

It is another object of the invention to provide a support and safety garment that can be worn on the ground with comfort and without in any way restricting the mobility of the user.

It is a further object of the invention to provide a safety and support garment that when worn on the ground provides lumbar support to the user and provides a ready seat to the user to insulate the user from cold or wet ground, for example.

It is yet another object of the invention to provide a support and safety garment that is easy to use, relatively inexpensive, and which has a long useable life.

These and other objects and features of the invention will become more evident from the detailed description and accompanying drawings which fully disclose all the features and uses for the invention.

SUMMARY OF THE INVENTION

The safety and support garment of the invention is a combination of a girdle that is worn by the user, a rigid seat and support and safety straps. The garment includes a to girdle with leg holes through which the user extends his or her legs and pulls the garment up around the waist. A rigid seat is secured to the girdle and is swung upwardly around the user's back while the user is on the ground. The seat is held in place by a strap attached to each side which will also serve as a support strap when the user is in a tree. In addition, a rope of an adjustable length is attached to the girdle as a safety rope for encircling the tree and allowing the user to freely move completely around the tree Suspenders or an additional harness may also be attached to the girdle for additional support and comfort.

BRIEF DESCRIPTION OF THE DRAWING

FIG. 1 is a lay-out of the garment of the invention showing the garment as it would appear laid out flat and when viewed from the front;

FIG. 2 is a view of the seat and main support strap;

FIG. 3 is a side view showing the user wearing the garment of the invention while on the ground;

FIG. 4 is a rear view of a user wearing the garment, viewing the garment from the rear;

DESCRIPTION OF THE PREFERRED EMBODIMENT OF THE INVENTION

FIG. 1 shows the supporting and safety garment of the invention laid out flat so that the various parts can be easily identified. FIG. 1 views these parts as if they were laid out with the front facing out from the page. One of the main components of the garment is a girdle 10 that has two leg openings 12 and an upper or waist portion 14 that is secured to the user by a belt 16 which can be or any suitable material or it can be a rope or heavy cord. If desired, the girdle 10 can be partly open at the front and fastened together with suitable fasteners (not shown) for ease of the user in putting on the girdle 10. The belt 16 serves to secure the girdle 10 around the waist of the user. In addition, the belt 16 serves as a safety belt to which other components of the garment can be attached in the manner described hereinafter.

Figure 5:
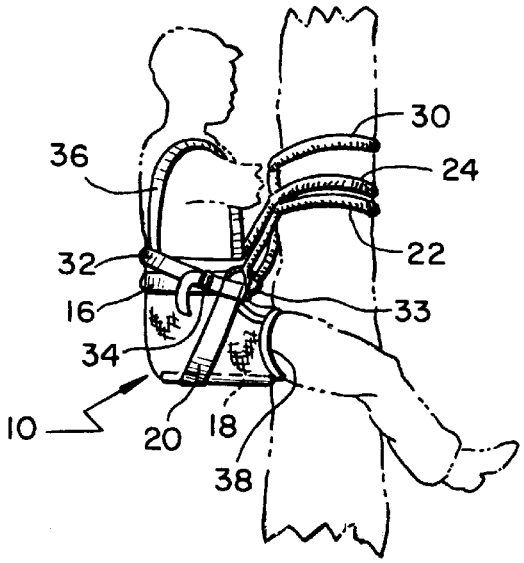
FIG. 5 is a view showing the user seated in a tree.
Figure 6:
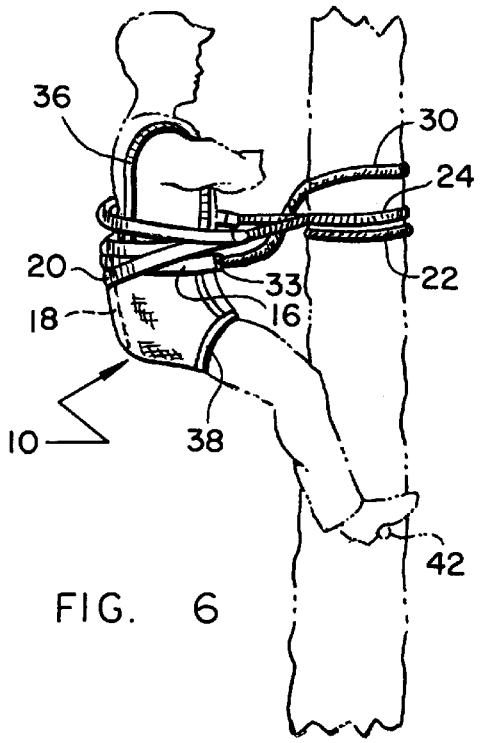
FIG. 6 is a view showing a user standing in a tree.

Secured to the rear of the girdle 10 at the back of the girdle 10 is a rigid seat 18 that can be formed of a suitable lightweight but rigid material such as plastic. The seat 18 is attached to the girdle by a main support belt 20 which is wrapped around the sides of the girdle 10 and attached to the girdle 10 preferably along the back. Main support belt 20 also maybe be rope, heavy cord or any other suitable material. The belt 20 allows the seat 18 to be strapped to the back of the user so as to provide lumbar support when the user is on the ground. This is shown in FIGS. 3 and 4. Also, when the user is being supported above the ground by the support and safety ropes in the manner described hereinafter, the seat 18 provides support for the user when in an upright, standing position in a tree. This is illustrated in FIG. 6, where the seat 18 is in its position at the back of the girdle 10. In addition if the user wishes to sit while above ground, the seat 18 will move down beneath the buttocks of the user so as to provide a seat when the user is in a tree and desires to be in a sitting position. This is shown in FIG. 5.

The outer ends of the main support belt 20 are preferably provided with a pair of support chords or ropes 22 and 24 which are affixed at their proximal ends to the main support belt 20 in any suitable manner such as by attachment to rings 26. Snap rings or hooks 28 are affixed to the support ropes 22 and 24 at their outer or distal ends. If desired, the main support belt 20 and the support ropes 22 and 24 can be a single, continuous member constructed of suitable material to form a strap, belt, rope or heavy cord. The purpose and use of these support ropes will be described hereinafter.

Also securely affixed to the safety belt 12 is a climbing and safety rope 30 which has a snap hook 31 at its outer end. When in use, the snap hook 31 of the safety rope 30 attaches to a D-ring 33 that is attached to the belt 16 so that the D-ring can slide along the belt 16. Also, a lumbar support belt 32 is attached to the main support belt 20 at one end of the belt 20 with the other end of the lumbar support belt being attached to the opposite end of the main support belt 20. The garment of the invention is fully functional without the lumbar support belt 32, but the belt 32 does allow the user to recline for added comfort and it also will minimize the tendency of the user to fall backwards when in the sitting position shown in FIG. 5. Also, when the individual is in the more upright or standing position shown in FIG. 6, the lumbar support belt 32 provides additional comfort, security and balance. To facilitate attachment of the lumbar support belt 32 to the main support belt 20, the belt 32 is provided with an adjustable clip 34.

In addition to the above, the garment of the invention can be provided with suspenders 36 attached at one end to the safety belt 16 and after passing over the shoulders of the user, are attached at the other ends to the front of the main support belt 16. In addition, the leg openings 12 may be provided with leg straps 38 extending around the leg openings 12 which leg straps 38 would be attached to the safety belt 16 by connecting straps 40. If used, the suspenders 36, leg straps 38 and the safety belt 16 provide a harness that positively and absolutely secures the entire upper body of the user.

In use, the user places the girdle on the lower body by extending the legs through the leg openings 12 and pulling the waist portion 14 up until it is secure around the user's waist. The safety belt 16 is then secured. At this time, the seat 18 is secured by grasping support ropes 22 and 24 at their proximal ends and lifting the seat 18 upwardly and laterally so that the seat 18 is positioned in the small of the user's back. The support ropes 22 and 24 are then crossed in front of the user at the waist, wrapped one full turn around the users waist and then connected together using the snap hooks 28. The lumbar support belt 32 is then wrapped around the user's waist and attached at its free end to the ring 26 on the main support belt 20. At this time, the safety rope 30 is wrapped around the user's waist and connected to the D-ring 33 using the snap hook 31. In this position, the user is very comfortable, has lumbar support provided by the seat 18, and can move about freely. If the user wishes to sit on the ground, the main support belt 20 can be loosened to allow the seat 18 to swing down beneath the user's buttocks to provide a comfortable seat insulating the user from the ground.

When the user has selected a desired location for hunting or viewing, the user will climb to the desired position on a tree. This is commonly done using well known tree steps 42 (see FIG. 6). Before leaving the ground, the garment of the invention is secured to the tree by wrapping the safety rope 30 around the tree and hooking the free end to the D-ring 33 of the safety belt 16. The user then grasps the rope 30 as climbing progresses. After the user reaches the desired height, the free end of the support rope 22 is grasped and the rope 22 is wrapped around the tree and the distal or free end is secured to the proximal end of the rope using the snap hook 28. This creates a "slip knot". The support rope 24 is then wrapped around the tree and secured by snap hook 28 to the ring 26 on the user's other side. The two support ropes 22 and 24 thus form a slip knot that will grab the tree from both of the user's sides. While the user is climbing the tree, the safety rope 30 greatly assists the user in ascending the tree safely using the tree steps 42, and once positioned at the desired height, the ropes 22 and 24 provide safety and security while allowing the user free use of the hands and freedom of movement around the tree.

Once the user has climbed to the desired height, the user can stand in a position similar to that shown in FIG. 6 resting the feet on tree steps 42. For extended periods of time, it is often more comfortable for the user to sit by allowing the seat 18 to swing down beneath the user's buttocks. This provides a comfortable position as shown in FIG. 5. In either the sitting position shown in FIG. 5 or the standing position shown in FIG. 6, the user's hands are completely free, and the support ropes 22 and 24 and the safety rope 30 provide complete safety in either position. The lumbar support belt 32 provides additional comfort and support as well as added safety to minimize the tendency of the user to tilt backwards. The swinging action of the seat 18 allows the seat to be easily positioned from standing to sitting positions as well as providing for position of the seat 18 as a back support during transport when the user is on the ground.

By using the support ropes 22 and 24 as well as the safety rope 30, the user can move freely around a tree a full 360° to any position. This freedom and versatility of movement is an important feature of the invention.

Figure 7:
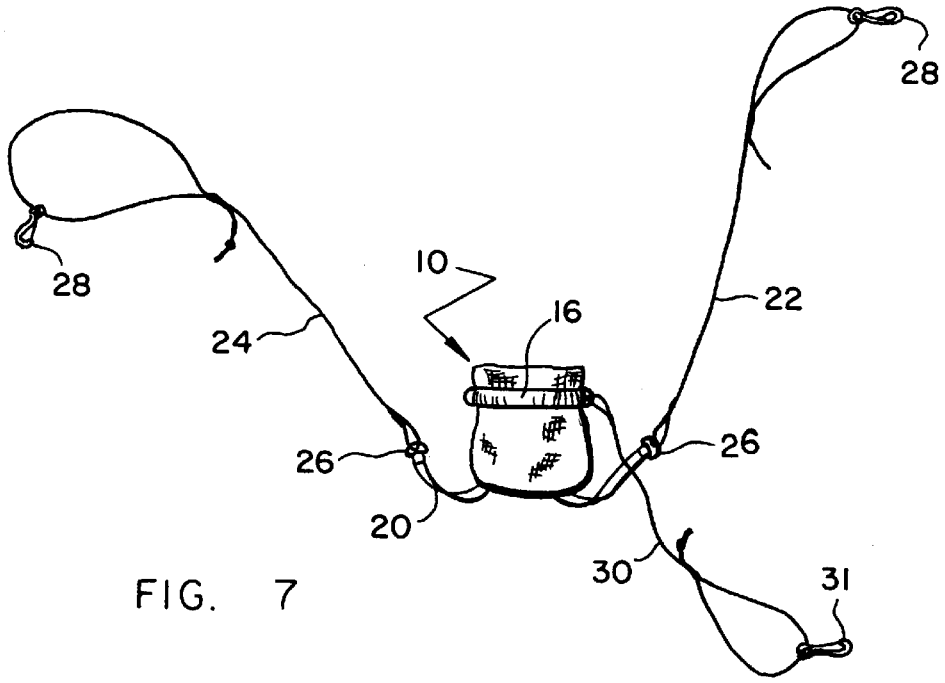
FIG. 7 is a lay-out view showing the supporting and safety straps and ropes.

FIG. 7 shows in more detail a preferred way of constructing the safety rope 30 and the support ropes 22 and 24. As illustrated in FIG. 7, if the ropes 22, 24 and 30 are made of heavy braided material, each rope can be made adjustable by threading one end of the rope into the hollow core of the braided rope and pulling it back through. A knot at the end of the rope will prevent it from slipping out. Obviously, standard hardware can also be used to provide for the adjustability of the ropes 22 and 24.

From the foregoing description, it is evident that the support and safety garment of the invention provides complete safety to a user while climbing the tree and while positioned at the desired height on the tree. Once at the desired position, the user's hands are free for any purpose. The seat of the invention provides not only support but comfort while the user walks along the ground or while positioned in a tree. Know prior art devices and articles often place the user in a vulnerable and dangerous position that could result in serious injury to the user. When used properly, the garment of the invention does not ordinarily place the user in a dangerous situation since the user is at all times secured to the tree.

Once positioned in a tree, and by using the support ropes and safety rope, a user can easily walk 360° around a tree to provide complete versatility of positioning. Because the entire support and safety garment of the invention is lightweight, it is comfortable for the user not only during transport but when used while positioned in a tree. The garment of the invention provides maximum safety and will thus greatly minimize the possibility of falls resulting in injury to the user.

A secondary use for the garment is that the seat can be used as a pad to sit on the ground or can be utilized as an equipment carrier. In addition, antlers can be quietly carried by wedging them between the user's back and the seat 18 when the seat 18 is in the lumbar support position. Also, a pouch can be attached to the belt 16 to facilitate the carrying of other gear such as tree step.

In describing the various components of the garment of the invention, reference has been made to components using the terms belt, rope, chord, strap, etc. It should be understood that in the context of the invention, these terms are used somewhat interchangeably. In other words, a "belt" could be a "rope", "strap" or "cord", and a "rope" could be a "belt", "strap" or "chord". The different terms are used to simplify the description and distinguish the components of the preferred embodiment, but it should be understood that a "belt" could be a "rope" and vice versa, as those terms are commonly understood. Also, there are numerous commercially available materials suitable for use in manufacturing the girdle, seat, straps, belts and ropes. There are also available standard D-rings, snap hooks and other hardware. It is not my intention to restrict the construction of the garment of the invention to any specific type of component or any material, but rather it is my intention to include within the scope of the invention any suitable component or material for a component that will serve the purposes described herein for the garment. Therefore, having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follow:

1. A safety and support garment that is worn by a user to assist the user in climbing a tree and then maintaining either a standing or sitting position in the tree, said garment comprising: a girdle having an upper portion and a lower portion adapted to extend downwardly along the back of the user from the waist; a safety belt combined with the girdle at its upper portion and adapted to encircle the user's waist; a rigid seat having a front, rear and sides positionable along the lower portion of the girdle and having a width sufficient to extend across the buttocks of the user and therefore being adapted to be positioned beneath the user to serve as a support when in a use position, the seat overlapping the girdle when in a non-use position; and a main support belt attached to the sides of the seat, the length of the main support belt being adjustable and of a sufficient length to encircle a tree being climbed by the user, the main support belt having a free end attachable to the seat to support the seat from its sides.

2. The garment of claim 1 in which a first support rope having a proximal end and a distal end forms a part of the main support belt to provide the length sufficient for the main support belt to encircle a tree.

3. The garment of claim 1 in which a second support rope having a proximal end and a distal end is attached to the main support belt on the side of the user opposite the first support rope, the second support rope being of sufficient length to encircle a tree.

4. The garment of claim 3 in which each of the first and second support ropes are provided with connecting hooks at their distal ends, the connecting hooks being adapted for attaching the distal ends to the proximal ends of the respective ropes after encircling a tree.

5. The garment of claim 4 in which the main support belt and the first and second support ropes are a single integrated component.

6. The garment of claim 5 in which a safety rope is combined with the safety belt, the safety rope having a free end adapted to be attached to the garment for support and safety of the user, the safety rope being of a sufficient length to encircle a tree so as to assist the user in climbing the tree while providing for free movement of the user completely around the tree.

7. The garment of claim 6 in which the safety rope and the first and second support ropes are each adjustable in length.

8. The garment of claim 1 in which a safety rope is combined with the safety belt, the safety rope having a free end adapted to be attached to the garment for support and safety of the user, the safety rope being of a sufficient length to encircle a tree so as to assist the user in climbing the tree while providing for free movement of the user completely around the tree.

9. The garment of claim 8 in which the safety rope is adjustable in length.

10. The garment of claim 9 in which the free end of the safety rope is adapted to be attached to the safety belt.

11. The garment of claim 8 in which there is a lumbar support belt having free ends adapted to be attached to the main support belt, the lumbar support belt extending around the lower body of the user.

12. The garment of claim 1 in which there is a pair of suspenders adapted to be attached to the girdle.

13. The garment of claim 1 in which the seat is adapted to be positioned around the user's back while the user is on the ground to provide lumbar support.

* * * * *